US009581338B2

(12) United States Patent
Yamanaka et al.

(10) Patent No.: US 9,581,338 B2
(45) Date of Patent: Feb. 28, 2017

(54) EXTRACTOR HOOD

(75) Inventors: Masanori Yamanaka, Aichi (JP); Takashi Tonokakiuchi, Aichi (JP); Hirosato Sakai, Aichi (JP); Masamichi Kachi, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 580 days.

(21) Appl. No.: 13/992,008

(22) PCT Filed: Feb. 22, 2012

(86) PCT No.: PCT/JP2012/001192

§ 371 (c)(1),
(2), (4) Date: Jun. 6, 2013

(87) PCT Pub. No.: WO2012/114736

PCT Pub. Date: Aug. 30, 2012

(65) Prior Publication Data

US 2013/0255661 A1 Oct. 3, 2013

(30) Foreign Application Priority Data

Feb. 25, 2011 (JP) ..... 2011-039789

(51) Int. Cl.

| | |
|---|---|
| ***F24C 15/20*** | (2006.01) |
| ***F24F 7/06*** | (2006.01) |
| *F24F 7/00* | (2006.01) |

(52) U.S. Cl.

CPC ..... *F24C 15/2042* (2013.01); *F24C 15/2021* (2013.01); *F24F 7/06* (2013.01); *F24F 2007/001* (2013.01)

(58) Field of Classification Search

CPC ..... F24C 15/2021; H05B 1/0266

(Continued)

(56) References Cited

U.S. PATENT DOCUMENTS 3,690,245 A * 9/1972 Ferlise ..... F24C 15/2021 126/299 D
4,568,201 A * 2/1986 Noda ..... H05B 6/6455 374/120

(Continued)

FOREIGN PATENT DOCUMENTS

CN 101285601 A * 10/2008 ..... F24C 15/2085
JP 8-105851 4/1996

(Continued)

OTHER PUBLICATIONS

CN 101285601 A; English Abstract.*

*Primary Examiner* — Jorge Pereiro
(74) *Attorney, Agent, or Firm* — RatnerPrestia

(57) ABSTRACT

An extractor hood changes an air volume of a fan in response to a temperature of a cooking subject on a cooker. The hood includes an infrared sensor that detects an average temperature between the cooking subject temperature and an ambient temperature of the cooking subject, a temperature sensor that detects an ambient temperature of the cooker, a signal receiver, and an air-volume controller. The air volume controller calculates the cooking subject temperature based on the average temperature by using the ambient temperature of the cooker as the ambient temperature of the cooking subject, and then determines the air volume of a fan based on the cooking subject temperature and a cooker signal.

10 Claims, 10 Drawing Sheets

(58) Field of Classification Search
USPC ..... 126/299 R, 299 D; 250/339.04
See application file for complete search history.

(56) References Cited

U.S. PATENT DOCUMENTS

| | | | | | |
|---|---|---|---|---|---|
| 4,903,685 | A * | 2/1990 | Melink | F24C 15/2021 | 126/299 D |
| 5,585,631 | A * | 12/1996 | Deguchi | G08B 13/191 | 250/332 |
| 5,614,716 | A * | 3/1997 | Rupert | G01J 5/16 | 219/494 |
| 5,744,786 | A * | 4/1998 | Kim | H05B 6/6447 | 219/494 |
| 5,805,718 | A | 9/1998 | Inoshiri et al. | | |
| 6,132,084 | A * | 10/2000 | Whipple, III | H05B 6/6455 | 219/711 |
| 6,169,486 | B1 * | 1/2001 | Berkcan | H05B 3/746 | 340/584 |
| 6,198,084 | B1 * | 3/2001 | Kim | H05B 6/6455 | 219/703 |
| 6,446,624 | B1 * | 9/2002 | Chu | B08B 15/02 | 126/299 D |
| 6,484,713 | B1 * | 11/2002 | Schmitt | F24C 15/2021 | 126/299 D |
| 6,515,285 | B1 * | 2/2003 | Marshall | G01J 5/20 | 250/339.03 |
| 6,578,569 | B2 * | 6/2003 | Liese | F24C 15/2021 | 126/299 D |
| 6,920,874 | B1 * | 7/2005 | Siegel | F24C 15/2021 | 126/21 A |
| 7,699,051 | B2 * | 4/2010 | Gagas | F24C 15/2028 | 126/299 D |
| 2002/0074499 | A1 * | 6/2002 | Butler | G01J 5/10 | 250/338.1 |
| 2003/0136908 | A1 * | 7/2003 | Pfister | G08B 13/19 | 250/338.1 |
| 2005/0029453 | A1 * | 2/2005 | Allen | G01J 5/06 | 250/332 |
| 2006/0049172 | A1 * | 3/2006 | Gagas | F24C 15/18 | 219/521 |
| 2006/0278216 | A1 * | 12/2006 | Gagas | F24C 15/2028 | 126/299 D |
| 2007/0120058 | A1 * | 5/2007 | Blackwell | G01J 5/061 | 250/338.1 |
| 2011/0284091 | A1 * | 11/2011 | Livchak | F24C 15/2021 | 137/2 |
| 2012/0111852 | A1 * | 5/2012 | Bach | H05B 1/0266 | 219/448.11 |

FOREIGN PATENT DOCUMENTS

| | | | | | |
|---|---|---|---|---|---|
| JP | 8-338765 | | | 12/1996 | |
| JP | 9-280619 | A | | 10/1997 | |
| JP | 11-281106 | A | | 10/1999 | |
| JP | 2001-065870 | | | 3/2001 | |
| JP | 2003-83550 | A | | 3/2003 | |
| JP | 2009092338 | A | * | 4/2009 | |
| JP | 2009-121751 | A | | 6/2009 | |
| JP | 2009-144964 | A | | 7/2009 | |
| KR | GB 2323929 | A | * | 10/1998 | G01J 5/14 |
| WO | WO 2010/065793 | A1 | | 6/2010 | |

* cited by examiner

EXTRACTOR HOOD

TECHNICAL FIELD

The present invention relates to extractor hoods.

BACKGROUND ART

A conventional extractor hood, which changes an air volume from a fan in response to a temperature of a food to be cooked or a cooking pan (hereinafter referred to as "cooking subject"), includes an exhaust fan motor, a temperature sensor of thermal electromotive force type, and a controller. The exhaust fan motor discharges oil soot and smell, generated in cooking, outside the kitchen. The temperature sensor of thermal electromotive force type detects far-infrared radiation around the cooker. The controller converts the result detected by the thermal sensor into a temperature. The extractor hood identifies the usage state of the cooker based on the temperature converted by the controller, and then drives or stops the exhaust fan motor. (This structure is disclosed in, e.g. Patent Literature 1.)

The extractor hood disclosed Patent Literature 1 compares the temperature detected this time by the temperature sensor of thermal electromotive force type with a temperature to be detected next time after a certain time by the sensor, and when the difference between these two temperatures becomes a predetermined one, the extractor hood starts driving the exhaust fan motor.

The extractor hood disclosed in Patent Literature 1, however; is greatly affected by a temperature at the beginning of temperature detection and a heating state of cooking, because the extractor hood starts controlling the air volume when the difference between the two temperatures becomes the predetermined one.

CITATION LIST

Patent Literature

PTL 1: Unexamined Japanese Patent Application Publication No. 2009-121751

SUMMARY OF THE INVENTION

An extractor hood of the present invention includes a fan that can change an air volume in response to a temperature of a cooking subject being cooked on a cooker. The hood also includes an infrared sensor that detects a temperature of the cooking subject placed on a top face of the cooker and a temperature of the top face of the cooker adjacent to the cooking subject, a temperature sensor that detects an ambient temperature of the cooker, a cooker signal receiver for receiving a signal from the cooker, and an air-volume controller for changing the air volume of the fan. The air-volume controller calculates the temperature of the cooking subject based on the average temperature by using the ambient temperature of the cooker as the ambient temperature of the cooking subject, and then determines the air volume of the fan based on the temperature of the cooking subject and the cooker signal from the cooker.

Assume that a cooking subject of a given size is placed on the cooker, and the ambient temperature of the cooking subject is equal to the ambient temperature, detected by the temperature sensor, of the cooker. This assumption allows calculating the temperature of the cooking subject based on the ambient temperature of the cooker and the average temperature of the top face of the cooker. The air volume from the fan is then controlled in response to the cooking subject temperature calculated and the cooker signal supplied from the cooker. This mechanism allows controlling the air volume free from being affected by a temperature state at the beginning of temperature detection and a heating state of the cooking subject.

DESCRIPTION OF EMBODIMENT

An exemplary embodiment of the present invention is demonstrated hereinafter with reference to the accompanying drawings.

Exemplary Embodiment

Figure 1:
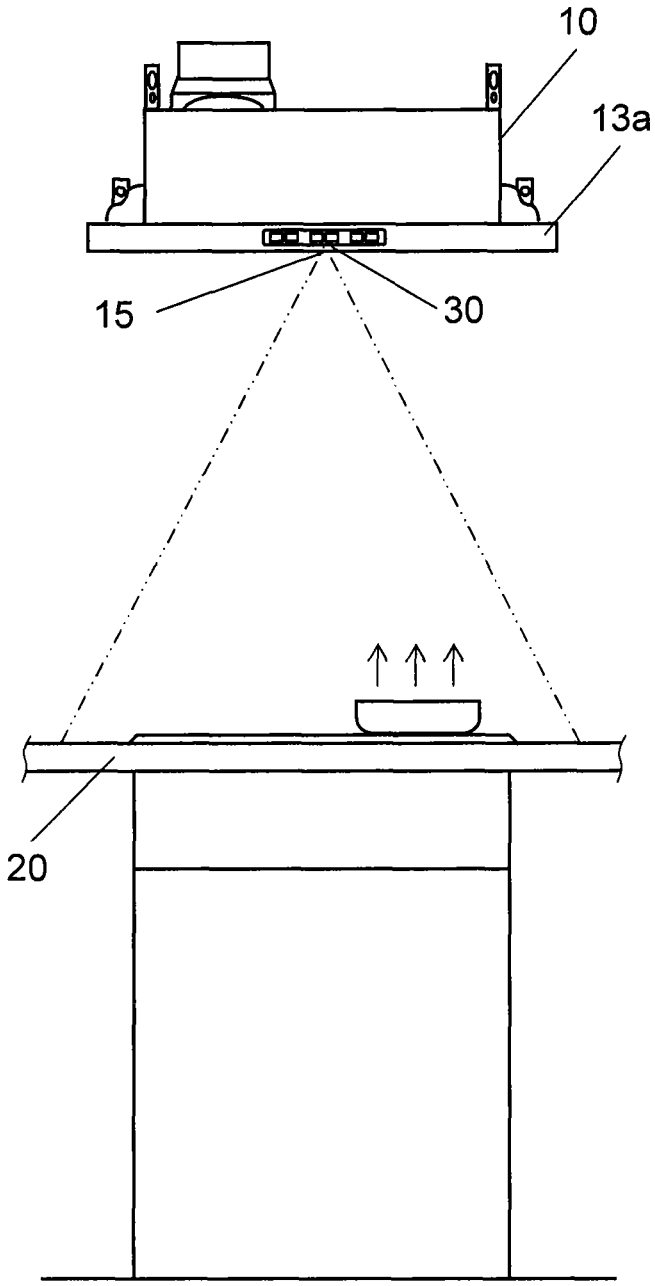
FIG. 1 is a front view illustrating an installation state of an extractor hood in accordance with an embodiment of the present invention.
Figure 2:
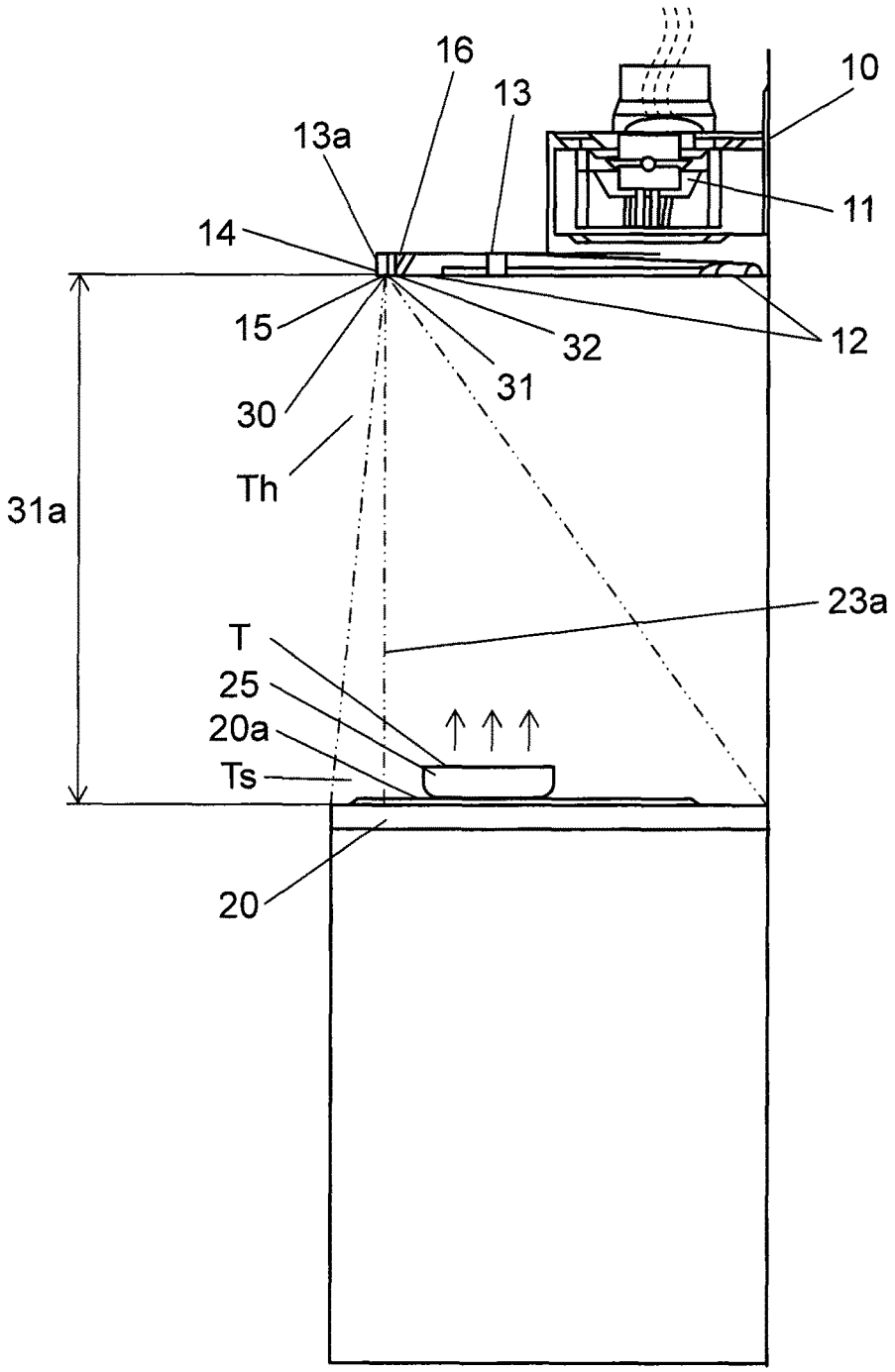
FIG. 2 is a lateral view of an essential part of the extractor hood for illustrating the installation state of the extractor hood.

FIG. 1 is a front view illustrating an installation state of an extractor hood in accordance with the embodiment of the present invention. FIG. 2 shows a lateral view of an essential part of the hood for illustrating the installation state of the extractor hood.

As shown in FIG. 1, extractor hood 10 is disposed above cooker 20, and as shown in FIG. 2, hood 10 includes fan 11 therein, which can change an air volume, and also includes hood main body 13 having sucking port 12 on the underside. Hood main body 13 has hood front section 13*a* on this side of sucking port 12.

Figure 3:
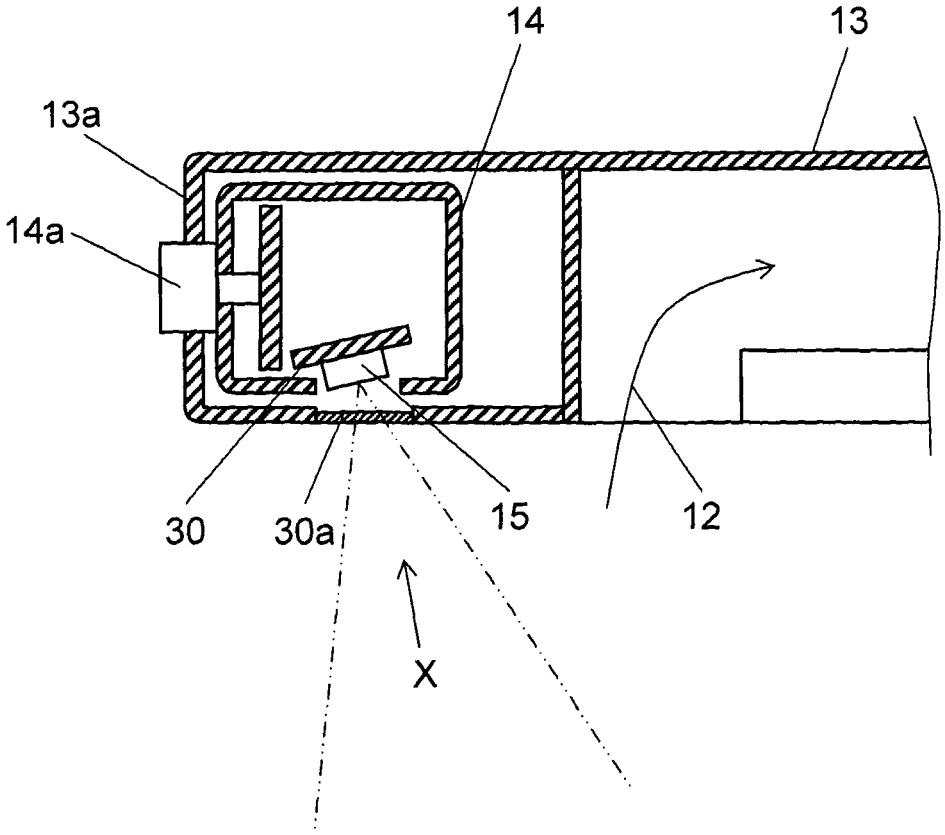
FIG. 3 is an enlarged sectional view of the essential part shown in FIG. 2.

FIG. 3 is an enlarged sectional view of the essential part of FIG. 2. As shown in FIG. 3, hood front section 13*a* has operating switch housing 14, and operating switch 14*a* is disposed on the front of housing 14. In switch housing 14, infrared type temperature sensor unit 30 and signal receiver 15 are disposed.

Figure 4:
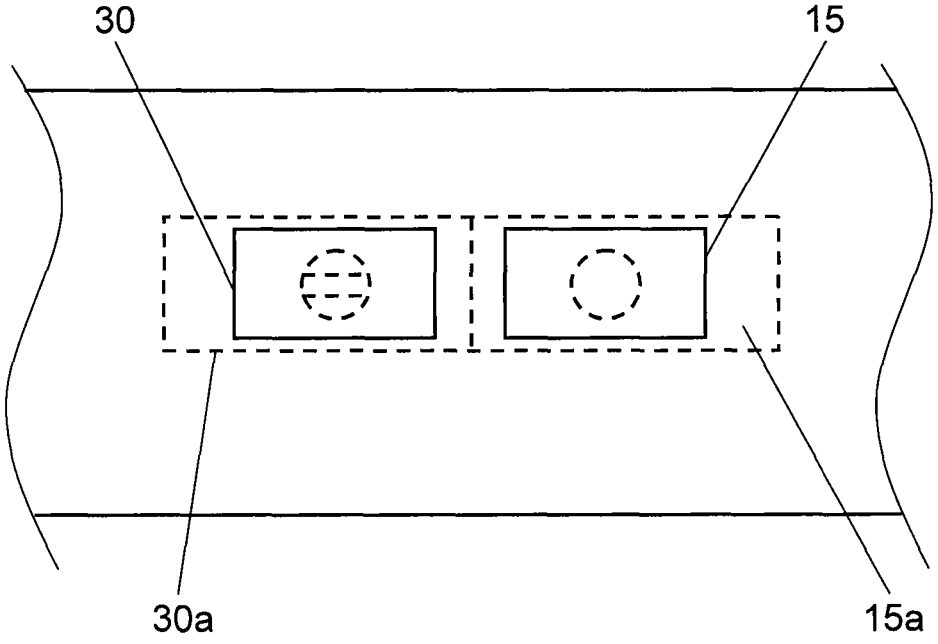
FIG. 4 is a bottom view of the essential part viewed along X-direction in FIG. 3.

FIG. 4 is a bottom view of an essential part of hood main body 13 viewed along X-direction shown in FIG. 3. As shown in FIG. 4, sensor cover 30*a* is disposed on the underside of sensor unit 30, and signal receiver cover 15*a* is disposed on the underside of signal receiver 15.

Figure 5:
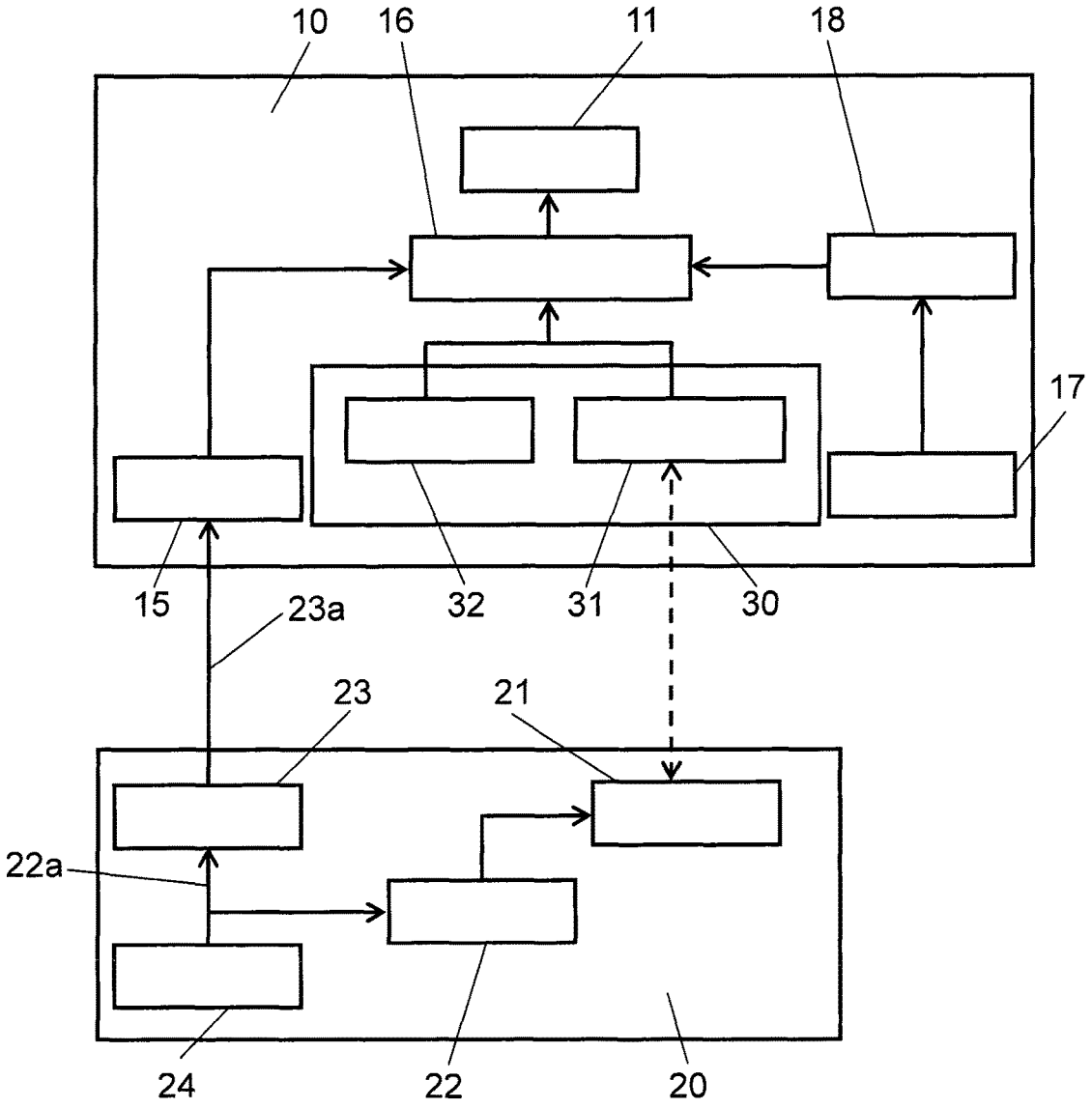
FIG. 5 is a block diagram of the extractor hood in accordance with the embodiment in which function implementing means illustrate how the extractor hood works.

FIG. 5 is a block diagram of the extractor hood in accordance with the embodiment in which function implementing means illustrate how the extractor hood works. As shown in FIG. 5, infrared type temperature sensor unit 30 is formed of infrared sensor 31 and temperature sensor 32. Infrared sensor 31 detects a temperature Tp derived from a temperature T of the cooking subject placed on top face 20*a* of cooker 20 and a temperature Ts of the top face 20*a* of cooker 10 adjacent to the cooking subject shown in FIG. 2, and temperature sensor 32 detects ambient air temperature Th of cooker 20 shown in FIG. 2. From the following the term "average temperature Tp" may be used instead of temperature Tp". Extractor hood 10 then changes the air volume of fan 11 in response to temperature T of the cooking subject placed on cooker 20.

As shown in FIG. 5, extractor hood 10 includes signal receiver 15 for receiving cooker signal 23*a* from cooker 20 and air-volume controller 16 for changing the air-volume of fan 11. Extractor hood 10 further includes input setting section 17 and memory 18. Input setting section 17 receives data of, e.g. an installation date of hood 10, a type of cooker 20, namely, an electromagnetic induction cooker or a gas cooker, and height 31*a* of infrared sensor 31 from cooker 20. Those data are stored in memory 18, which also has stored the data of cooking subject occupying area Sa for identifying temperature T of the cooking subject.

As shown in FIG. 5, cooker 20 includes heating section 21, heat adjuster 22 for adjusting the heat. On top of that, cooker 20 sometimes includes signal transmitter 23 and memory 24. A heat signal supplied from heat adjuster 22, and a signal representing a type of cooker 20 and having been stored in memory 24 are transmitted from signal transmitter 23. The type of cooker 20 refers to as an electromagnetic induction cooker or a gas cooker. Cooker signal 23*a* transmitted from transmitter 23 is received by signal receiver 15.

In the case of extractor hood 10 equipped with signal transmitter 23 and memory 24, the input of the type of cooker 20 into input setting section 17 is not needed.

Figure 6A:
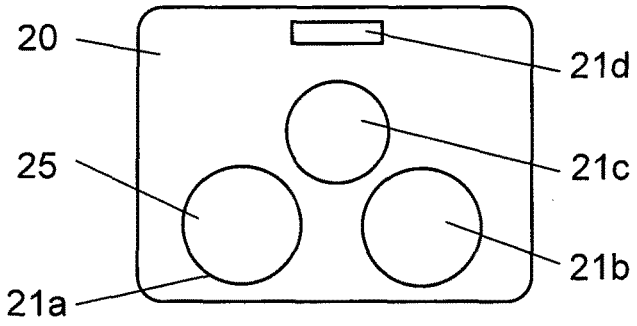
FIG. 6A is a top view of the cooker for illustrating a process in an air-volume controller of the extractor hood.
Figure 6B:
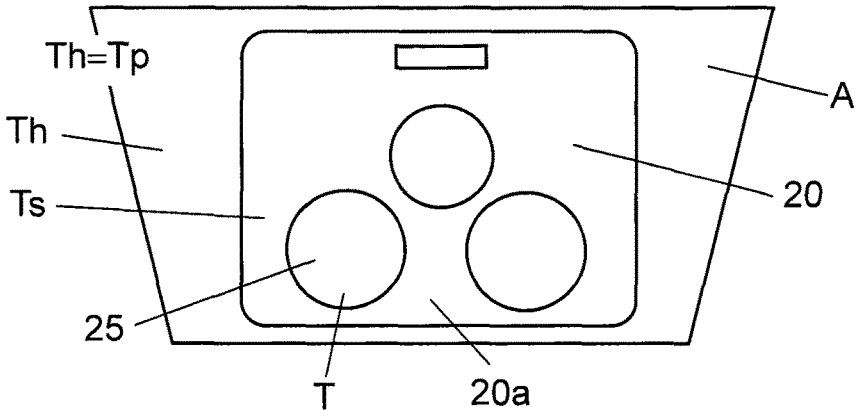
FIG. 6B shows a cooking section, not heated, of the cooker for illustrating a process in the air-volume controller of the extractor hood.
Figure 6C:
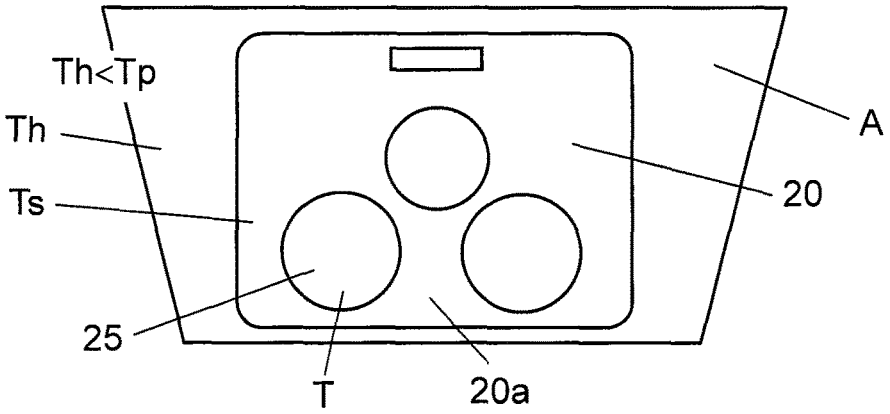
FIG. 6C shows the cooking section, being heated, of the cooker and a cooking subject temperature rising to a given temperature for illustrating a process in the air-volume controller of the extractor hood.

FIG. 6A shows a top face of the cooker for illustrating a process at the air-volume controller of the extractor hood in accordance with this embodiment. Cooker 20 includes four cooking sections 21*a*, 21*b*, 21*c*, and 21*d*. Cooking subject (pan 25) to be heated is placed on cooking section 21*a*. FIG. 6B shows the cooking sections not heated for illustrating a process at the air-volume controller of the extractor hood in accordance with this embodiment. FIG. 6C shows the cooking sections, where the pan is heated to a given temperature, for illustrating a process at the air-volume controller of the extractor hood in accordance with this embodiment. In FIGS. 6B and 6C, detectable range A by infrared sensor 31 is shown.

Detectable range A covers not only pan (cooking subject) 25 but also areas other than cooking subject 25. Infrared sensor 31 thus detects a temperature Tp derived from a temperature T of cooking subject 25 and a temperature Ts of top face 20*a* of cooker 20 adjacent to cooking subject 25. Temperature sensor 32 detects ambient air temperature Th of cooker 20.

As discussed above, assume that cooking subject 25 having, a certain size is placed on cooker 20, and temperature Tp is equal to ambient air temperature Th detected by temperature sensor 32 (refer to FIG. 6B). This assumption allows calculating temperature T of the cooking subject by using ambient air temperature Th of cooker 20 and temperature Tp of top face 20*a* of cooker 20.

Figure 7:
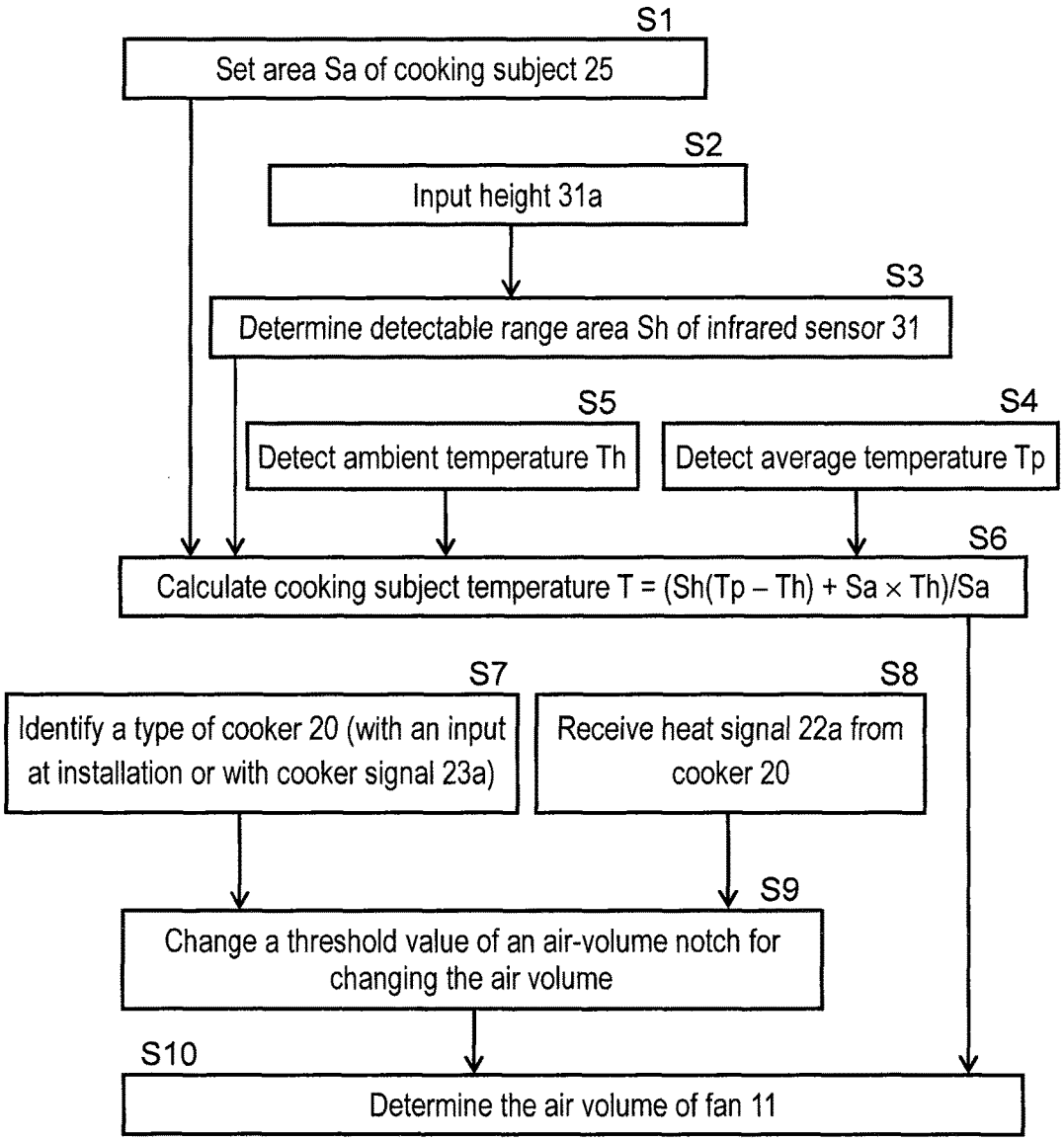
FIG. 7 is a flowchart of the air-volume controller of the extractor hood.

FIG. 7 is a flowchart of the air-volume controller of the extractor hood in accordance with the embodiment. As shown in FIGS. 5 and 7, in step 1 (S1), area Sa of cooking subject 25 is set in advance and stored in memory 18. Step 1 is implemented during the manufacturing or at an initial setting.

Step 2 (S2) is implemented when extractor hood 10 is installed, and height 31*a* from cooker 20 to infrared sensor 31 is input through input setting section 17, because detectable range A is changed depending on height 31*a*, by which detectable range area Sh of infrared sensor 31 can be changed (step 3 (S3)). It is preferable to store detectable range area Sh, associated with height 31*a* in advance, of sensor 31 into memory 18 when height 31*a* is input.

Step 4 (S4) and the steps, onward, are implemented when extractor hood 10 is actually used. At this time, infrared sensor 31 detects average temperature Tp derived from a temperature T of the cooking subject and temperature Ts of top face 20*a* of cooker 20 adjacent to the cooking subject in step 4 (S4). Then temperature sensor 32 detects ambient air temperature Th of cooker 20 in step 5 (S5).

The detection of average temperature Tp and ambient temperature Th allows air-volume controller 16 to calculate temperature T of the cooking subject in step 6 (S6), in addition to cooking subject area Sa obtained in step 1 (S1) and detectable range area Sh obtained in step 3 (S3). Temperature T of the cooking subject can be calculated, e.g. with a difference between average temperature Tp and ambient temperature Th together with a ratio of cooking subject area Sa vs. detectable range area Sh.

Identifying the type of cooker 20 in step 7 (S7) can be done either when extractor hood 10 is installed in step 2 or when extractor hood 10 is actually used. In the case of cooker 20 having no signal transmitter 23, the type of cooker 20 is input through input setting section 17 when extractor hood 10 is installed in step 2, and this input is stored in memory 18.

In the case of cooker 20 having signal transmitter 23, an electromagnetic induction cooker transmits cooker signal 23*a* different from that of a gas cooker when extractor hood 10 is in operation. Hood 10 identifies, based on cooker signal 23*a* received, the type of cooker 20, i.e. the gas cooker or the electromagnetic induction cooker. Cooker signal 23*a* thus allows extractor hood 10 to identify the type of cooker 20. As a result, a setting in connection with the type of cooker 20 in extractor hood 10 is not needed.

In step 8 (S8), a relation of cooking subject temperature T vs. the air volume of fan 11 can be changed by, e.g. altering a threshold value of notches for changing the air volume. To be more specific, in the case of the electromagnetic induction cooker, cooking material and a temperature of the pan become chief heat sources. In the case of the gas cooker, cooking material, pan, and flame become chief heat sources. The threshold value of notches for changing the air volume is thus set higher for the gas cooker than that for the electromagnetic induction cooker, so that the air volume can be controlled in the same way to both of the same cooking done by the gas cooker or the electromagnetic induction cooker.

Cooker signal 23*a* supplied from cooker 20 includes heat signal 22*a*, which is received in step 8 (S8). In step 9 (S9), heat signal 22*a* allows changing the relation of cooking subject temperature T vs. an air volume of fan 11 by, e.g. altering a threshold value of notches for changing the air volume.

In step 10 (S10), cooking subject temperature T (calculated in step S6) and the relation (changed in step S9) of temperature T vs. the air volume allow air-volume controller 16 to determine the air volume of fan 11. Fan 11 is operated with the air volume thus determined.

As shown in FIG. 5, extractor hood 10 in accordance with the embodiment of the present invention includes infrared sensor 31, temperature sensor 32, signal receiver 15, and air-volume controller 16. As FIG. 2 shows, infrared sensor 31 detects a temperature derived from cooking subject temperature T on top face 20*a* of cooker 20 and temperature Ts of top face 20*a* of cooker 20 adjacent to the cooking subject. Temperature sensor 32 detects ambient air temperature Th of cooker 20. Signal receiver 15 receives cooker signal 23*a* from cooker 20. Air-volume controller 16 controls the air volume of fan 11.

Air-volume controller 16 uses ambient temperature Th detected by temperature sensor 32 as the ambient temperature Ts of the cooking subject, and calculates the cooking subject temperature T based on the average temperature Tp detected by infrared sensor 31. The cooking subject temperature T thus calculated and cooker signal 23*a* received at signal receiver 15 allow determining the air volume of fan 11. Place cooking subject 25 having a certain size on cooker 20, and assume that ambient temperature Ts of the cooking subject is equal to the ambient temperature Th of cooker 20. This assumption allows calculating the cooking subject temperature T by using ambient temperature Th and average temperature Tp of top face 20*a* of cooker 20. The air volume can be controlled based on the cooking subject temperature T thus calculated and cooker signal 23*a* supplied from cooker 20. As a result, the air volume can be controlled free from being affected by a temperature at the beginning of the detection or the heating state.

In the case of the electromagnetic induction cooker, cooking material and a temperature of the pan become chief heat sources. In the case of the gas cooker, cooking material, pan, and flame become chief heat sources. If the air volume is calculated with the same mathematical formula for the electromagnetic induction cooker and the gas cooker, a different air volume from each other is applied to the same cooking. However, extractor hood 10 of the present invention allows changing the relation of cooking subject temperature T vs. the air volume of fan 11 depending on the type of cooker 20, i.e. electromagnetic induction cooker or gas cooker. As a result, the air volume can be controlled in the same way to the same cooking regardless of the type of cooker 20.

In this embodiment, the gas cooker and the electromagnetic induction cooker transmit cooker signals 23*a* different from each other, so that extractor hood 10 can identify the type of cooker 20, i.e. the gas cooker or the electromagnetic induction cooker, based on a type of cooker signal 23*a* received. As a result, a setting to hood 10 in response to the type of cooker 20 is not needed.

In this embodiment, heat signal 22*a* supplied from cooker 20 is also used for controlling the air volume, which can be thus controlled free from being affected by the heating state.

In this embodiment, infrared sensor 31 and temperature sensor 32 form infrared-type temperature sensor unit 30, which simplifies the structure and reduces the cost.

Figure 8:
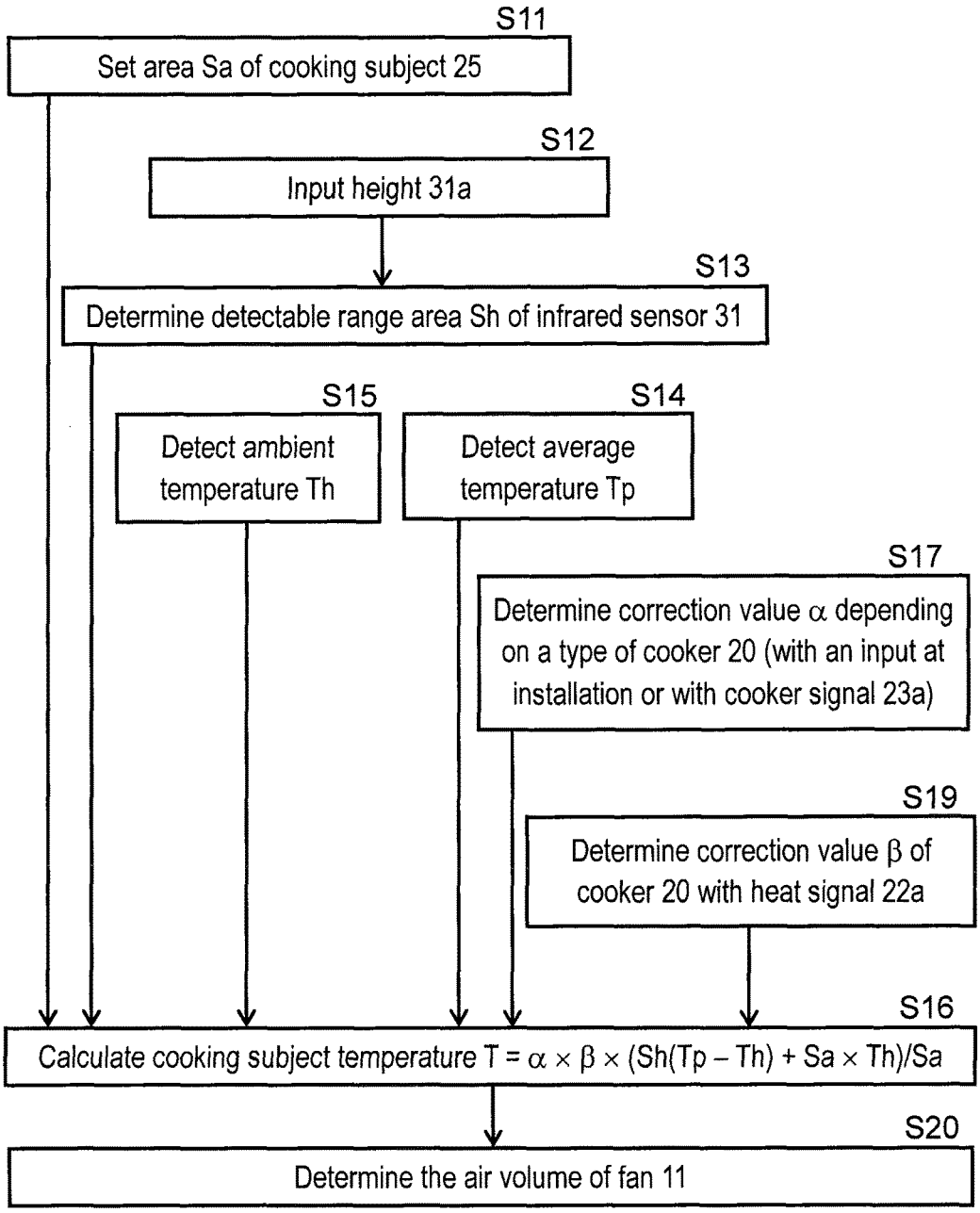
FIG. 8 is another flowchart of the air-volume controller of the extractor hood.

FIG. 8 is another flowchart of the air-volume controller of the extractor hood in accordance with the embodiment of the present invention. Step 11 (S11), step 12 (S12), step 13 (S13), step 14 (S14), and step 15 (S15) are the same as step 1, step 2, step 3, step 4 and step 5 respectively.

Step 17 (S17) differs from step 7 (S7), where the type of cooker 20 is identified, in this point: in step 17 (S17) correction value $\alpha$ is determined depending on whether cooker 20 is the electromagnetic induction cooker or the gas cooker, and then cooking subject temperature T calculated in step 16 (S16) is changed. Other performances remain unchanged from those in step 7.

Cooker signal 23*a* supplied from cooker 20 includes heat signal 22*a* that identifies the heating power of cooker 20. In step 19 (S19), heat signal 22*a* is received from cooker 20, and heat signal 22*a* determines correction value $\beta$, thereby changing cooking subject temperature T calculated in step 16.

In step 20 (S20), air-volume controller 16 determines the air volume of fan 11 based on cooking subject temperature T (calculated in step 16), and fan 11 is operated with the air volume thus determined.

As the flowchart in FIG. 8 shows, cooker 20 changes cooking subject temperature T depending on the type of cooker 20, i.e. the electromagnetic induction cooker or the gas cooker. As a result, the air volume can be controlled in the same way to the same cooking cooked by either one of the electromagnetic induction cooker or the gas cooker.

Figure 9:
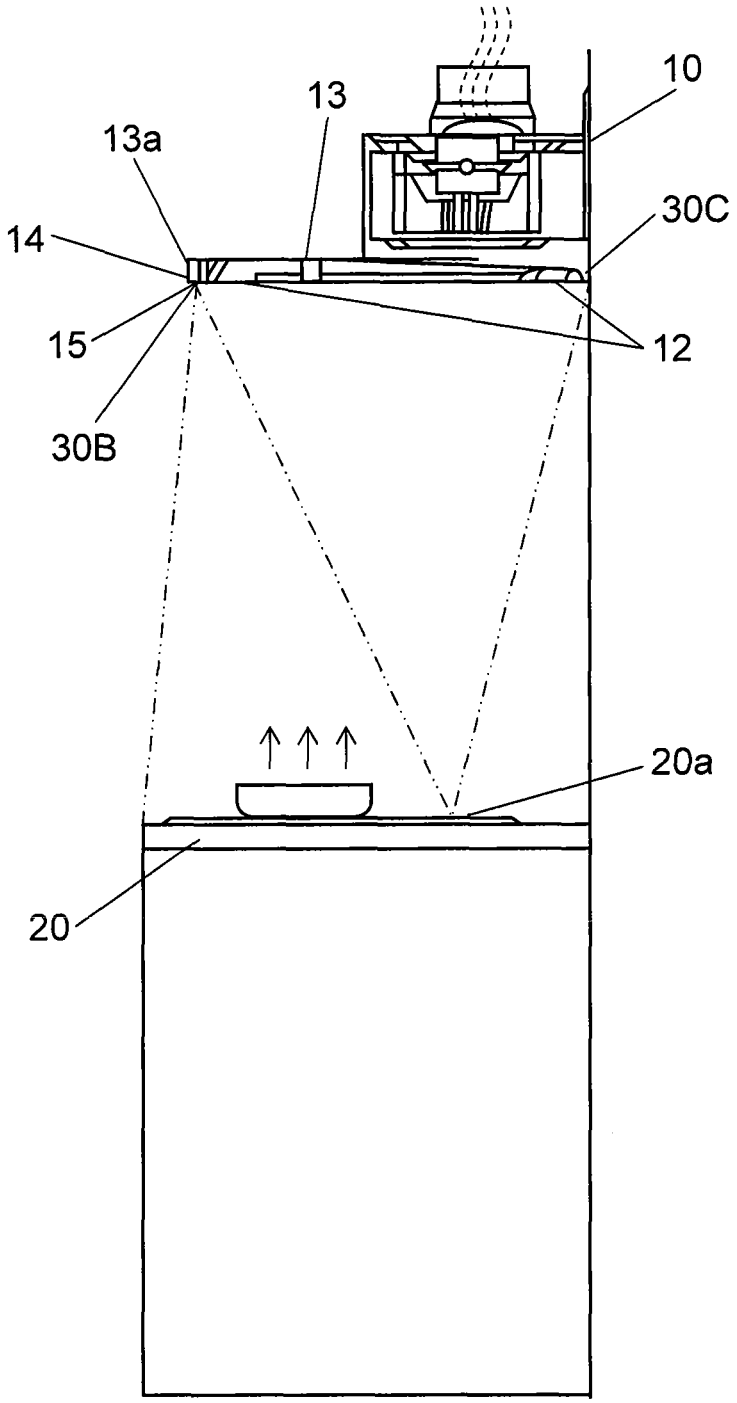
FIG. 9 is a lateral sectional view of an essential part of the extractor hood for illustrating another installation state.
Figure 10:
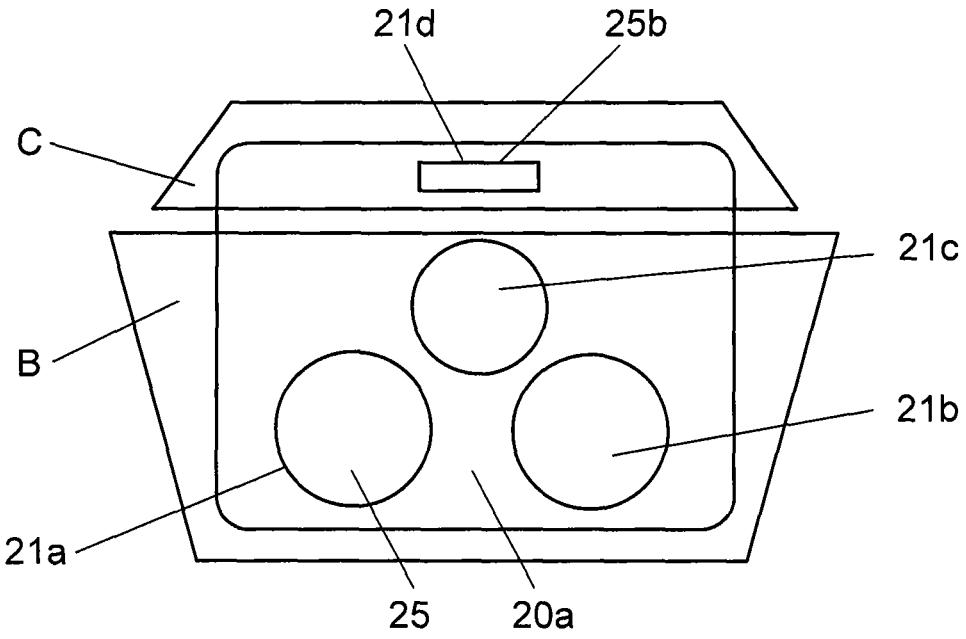
FIG. 10 shows a detectable range of the extractor hood.

FIG. 9 is a lateral view of an essential part of the extractor hood in accordance with the embodiment for illustrating another installation of the hood. FIG. 10 shows a detectable range of the same extractor hood. As FIG. 9 shows, extractor hood 10 includes multiple infrared type temperature units 30 each of which is formed of first infrared type temperature sensor unit 30B or second infrared type temperature sensor unit 30C.

First infrared type temperature sensor unit 30B shown in FIG. 9 covers detectable range B including cooking sections 21*a*, 21*b*, and 21*c* shown in FIG. 10. Second infrared type temperature sensor unit 30C covers detectable range C including cooking section 21*d*. First infrared type temperature sensor unit 30B detects average temperature Tp assuming that a pan is a cooking subject 25. Second infrared type temperature sensor unit 30C detects average temperature Tp assuming that a grill is a cooking subject 25.

As discussed above, extractor hood 10 includes first infrared type temperature sensor unit 30B and second infrared type temperature sensor unit 30C. This structure allows preventing a detection accuracy from lowering even when the detectable range is set so large as the entire top face 20*a* of cooker 20. At the grill cooking section, a temperature to be detected is lower than that of other cooking sections, and second infrared type temperature sensor unit 30C is set as an exclusive sensor for this section. As a result, the air volume can be changed in response to a cooking done at a place of good efficiency or a place of poor efficiency in terms of exhaust and collection, thereby achieving an efficient control of the air volume.

Instead of using multiple infrared type temperature sensor units 30, a compound-eye type sensor can be used as infrared sensor 31. The compound-eye type sensor can identify the grill cooking and also a place where the cooking is being done. As a result, the air volume can be changed in response to a cooking done at a place of good efficiency or a place of poor efficiency in terms of exhaust and collection, thereby achieving an efficient control of the air volume. On top of that, the temperature can be detected more accurately, so that the multiple infrared type temperature sensor units 30 are not needed.

In the foregoing embodiment, infrared type temperature sensor unit 30 formed of infrared sensor 31 and temperature sensor 32 is used. Temperature sensor 32 can be set at a place away from hood main body 13 for detecting a room temperature where cooker 20 is installed. As per the description of the foregoing embodiment, ambient temperature Th of cooker 20 possibly rises higher than the room temperature. However, the detection of the room temperature allows calculating cooking subject temperature T more accurately.

Extractor hood 10 in accordance with the embodiment reflects height 31*a* between cooker 20 and infrared sensor 31 in the calculation of cooking subject temperature T, so that a change in height 31*a* does not cause a change in temperature T.

INDUSTRIAL APPLICABILITY

The present invention is useful for extractor hoods that change an air volume of a fan in response to a cooking subject temperature on a cooker.

REFERENCE MARKS IN THE DRAWINGS

10 extractor hood
11 fan
12 sucking port
13 hood main body
13*a* hood front section
14 operating switch housing
14*a* operating switch
15 signal receiver
15*a* signal receiver cover
16 air-volume controller
17 input setting section
18 memory
20 cooker
20*a* top face
21, 21*a*, 21*b*, 21*c*, 21*d* cooking section
22 heat adjuster
23 signal transmitter
23*a* cooker signal
24 memory
25, 25*b* cooking subject
30, 30B, 30C infrared type temperature sensor unit
30*a* sensor cover
31*a* height
32 temperature sensor
T cooking subject temperature
Ts ambient temperature of cooking subject
Th ambient temperature
Tp average temperature

The invention claimed is:

1. An extractor hood equipped with a fan of which air volume can be changed in response to a temperature of a food to be cooked or a cooking pan, the food to be cooked or the cooking pan disposed on a cooker, the extractor hood comprising:

an infrared sensor for detecting a first temperature, the first temperature being derived from (i) a temperature of the food to be cooked or the cooking pan disposed at a top face of the cooker and (ii) a temperature of the top face of the cooker adjacent to the food to be cooked or the cooking pan;

a temperature sensor for detecting a second temperature, the second temperature being an ambient air temperature of the cooker;

a signal receiver for receiving a cooker signal supplied from the cooker; and an air-volume controller for changing the air volume of the fan, wherein the air-volume controller calculates a temperature of the food to be cooked or the cooking pan based on the first temperature and the second temperature, and then determines the air volume of the fan based on the temperature of the food to be cooked or the cooking pan, and the cooker signal, and wherein the temperature of the food to be cooked or the cooking pan is calculated by an equation, $$T=\alpha\times\beta\times(Sh(Tp-Th)+Sa\times Th)/Sa$$

where, T is the temperature of the food to be cooked or the cooking pan, α is a correction value depending on a type of the cooker, β is a correction value sent from the cooker, and Sh is a detectable range of infrared sensor, Tp is the first temperature, Th is the second temperature and Sa is an area of the food to be cooked or the cooking pan.

2. The extractor hood of claim 1, wherein a relation of the temperature of the food to be cooked or the cooking pan vs. the air volume of the fan can be changed depending on whether the cooker is an electromagnetic induction cooker or a gas cooker.

3. The extractor hood of claim 1, wherein the temperature of the food to be cooked or the cooking pan calculated can be changed depending on whether the cooker is an electromagnetic induction cooker or a gas cooker.

4. The extractor hood of claim 1, wherein a type of the cooker can be identified by the cooker signal.

5. The extractor hood of claim 1, wherein the cooker signal includes a heat signal by which heating power of the cooker is identified.

6. The extractor hood of claim 1, wherein the temperature sensor detects a temperature of a room where the cooker is installed.

7. The extractor hood of claim 1, wherein the infrared sensor and the temperature sensor form an infrared type temperature sensor unit.

8. The extractor hood of claim 7, wherein the hood includes a plurality of the infrared type temperature sensor units.

9. The extractor hood of claim 1, wherein the infrared sensor employs a compound-eye type sensor.

10. The extractor hood of claim 1, wherein a height between the cooker and the infrared sensor is reflected in the calculation of the temperature of the food to be cooked or the cooking pan.

* * * * *